US007938693B2

(12) United States Patent
Skowranek

(10) Patent No.: US 7,938,693 B2
(45) Date of Patent: May 10, 2011

(54) PE CONNECTION FOR PLUG CONNECTORS

(75) Inventor: Antje Skowranek, Horn-Bad Meinberg (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 57 days.

(21) Appl. No.: 12/531,831

(22) PCT Filed: Mar. 17, 2008

(86) PCT No.: PCT/EP2008/002107

§ 371 (c)(1),
(2), (4) Date: Sep. 17, 2009

(87) PCT Pub. No.: WO2008/113537

PCT Pub. Date: Sep. 25, 2008

(65) Prior Publication Data

US 2010/0087083 A1 Apr. 8, 2010

(30) Foreign Application Priority Data

Mar. 18, 2007 (DE) ..... 10 2007 013 536

(51) Int. Cl.
*H01R 4/36* (2006.01)

(52) U.S. Cl. ..... 439/811

(58) Field of Classification Search ..... 438/801, 438/811, 812, 815

See application file for complete search history.

(56) References Cited

U.S. PATENT DOCUMENTS

| | | | | |
|---|---|---|---|---|
| 3,246,283 | A * | 4/1966 | Huska | 439/716 |
| 3,496,521 | A * | 2/1970 | Hohorst | 439/717 |
| 3,539,977 | A * | 11/1970 | Woertz | 439/811 |
| 3,659,253 | A * | 4/1972 | Wiessner | 439/733.1 |
| 3,683,321 | A * | 8/1972 | Rauter et al. | 439/745 |
| 4,004,846 | A * | 1/1977 | Woertz | 439/724 |
| 7,404,745 | B1 * | 7/2008 | Wu | 439/811 |
| 7,473,146 | B2 * | 1/2009 | Fuzetti et al. | 439/798 |
| 7,798,869 | B1 * | 9/2010 | Konopacki et al. | 439/812 |
| 2004/0152367 | A1 | 8/2004 | Conrad | |

(Continued)

FOREIGN PATENT DOCUMENTS

CH 392658 A 5/1965

(Continued)

OTHER PUBLICATIONS

"PLUSCON 2002" Catalogue TNR 5123513 / 01.04.02.00 of the firm Phoenix Contact GmbH & Co KG, Blomberg.

*Primary Examiner* — Neil Abrams

(74) *Attorney, Agent, or Firm* — Leydig, Voit & Mayer, Ltd.

(57) ABSTRACT

An electrical plug connector includes an insulating body supporting electrical contact elements having a connector portion and a conductor connection portion. At least one retaining element is configured to contact a respective at least one contact insert and has at least one flange with at least one punched hole configured to fasten the electrical plug connector to at least one of a housing and a control cabinet. A tension sleeve has a terminal screw configured to connect a ground conductor with the electrically conductive metal element. A U-shaped frame is configured to receive and guide the tension sleeve. A conductor bar is disposed on the electrically conductive metal element angularly offset from the U-shaped frame and is configured to engage the tension sleeve.

9 Claims, 3 Drawing Sheets

U.S. PATENT DOCUMENTS

| | | | |
|---|---|---|---|
| 2005/0029003 | A1 | 2/2005 | Conrad |

FOREIGN PATENT DOCUMENTS

| | | | |
|---|---|---|---|
| DE | 1690745 | B1 | 5/1970 |
| DE | 8215606 | U1 | 9/1982 |
| DE | 3126535 | A1 | 2/1983 |
| DE | 8125854 | U1 | 8/1984 |
| DE | 242312 | A1 | 1/1987 |
| DE | 3732267 | C1 | 9/1988 |
| DE | 3735312 | C1 | 2/1989 |
| DE | 4228025 | A1 | 3/1994 |
| DE | 9408053 | U1 | 7/1994 |
| DE | 19934555 | C1 | 4/2001 |
| DE | 10315668 | A1 | 3/2004 |
| EP | 0519196 | A1 | 12/1992 |
| EP | 1394902 | A1 | 3/2004 |
| EP | 1403969 | A1 | 3/2004 |

* cited by examiner

PE CONNECTION FOR PLUG CONNECTORS

CROSS REFERENCE TO PRIOR APPLICATIONS

This application is a U.S. National Phase application under 35 U.S.C. §371 of International Application No. PCT/EP2008/002107, filed Mar. 17, 2008, and claims benefit to German Patent Application No. 10 2007 013 536.1, filed Mar. 18, 2007, both incorporated by reference herein. The International Application was published in German on Sep. 25, 2008 as WO 2008/113537 under PCT Article 21(2).

FIELD

The present invention relates generally to the field of electrical plug connectors, in particular to multipole terminal adapters and/or contact inserts.

BACKGROUND

Terminal adapters can be used for heavy-duty industrial plug connectors in the automotive industry, machine-building industry, in plant construction and in measuring and control engineering. Terminal adapters integrate plug-connector contact inserts and downstream series terminals into one space-saving, individual connection element. When used together with the corresponding housing, contact inserts provide for an industry-compatible leading-through of lines through control cabinet walls.

With regard to the conductor connections in the series terminal section, different connection techniques can be used for the 6 to 24-pole terminal adapters to facilitate a simple and rapid assembly. Different connection techniques can also be used for the contact inserts in the different performance classes including screw, crimp or insulation-displacement connections, the contact inserts being composed of female and male inserts.

Ground conductors are frequently used in electrical connection systems. These ground conductors are also referred to as earth potential. In electrical systems, the ground conductor has the task of protecting people from dangerous contact voltage and the system from further damage. The ground conductor is installed with the purpose of forming an electrical connection between the outer metallic housing of electrical equipment and the earth. In a fault scenario, when the electrical voltage of the supply system reaches the external components of the electrical equipment, the short circuit across the ground conductor serves to ensure that the voltage between the device housing and earth becomes zero.

At the same time, the electrical supply voltage is tripped by the short-circuit current that is produced. This very quickly isolates the defective equipment from the electrical supply voltage.

German regulations stipulate that ground conductors be identified by the color green/yellow. Cable connections leading to equipment having a metal housing and grounding-contact connection lines require that the ground conductor be incorporated therein in a cross section suited for the occurring amperage and that it match the energized lines. At grounding-contact plug connections, the ground conductor is connected to the grounding contacts which provide for an uninterrupted connection of the ground conductor.

Cited here exemplarily are terminal adapters (HC-KA) and contact inserts (HC-B) which are equipped with an integrated PE ground conductor system. See the product catalog "PLUSCON 2002" TNR 5123513/01.04.02.00 of the firm Phoenix Contact GmbH & Co KG, Blomberg.

Multipole electrical plug connectors having an insulating body supporting the electrical contact elements that has a connector side and a conductor connection side are described, for example, in the German Examined Application DD 242 312 A1 or the German Patent DE 82 15 606, or are described in the German Patent DE 37 35 312. In the case of these plug connectors, the ground conductor system is typically constituted of an electrically conductive, metallic fixing bracket upon which a screw connection is configured for receiving the ground conductor, the fixing bracket including a retaining member having a one-piece clip and being provided with a screw connection. The metal part, which is thin due to the sheet thickness typically used for this purpose, is provided with a thread for receiving the screw connection that can easily be overtightened in response to a forceful actuation. The screw connection itself is constituted of a metal screw and a metal disk, which is also described as a pressure plate and, in the square plate-like form, is umbrella-shaped. The metal screw and the small metal plate can be corrosion-protected by a galvanically applied nickel or tin coating.

In addition, from the German Utility Model Patent 81 25 854 U1 for connecting a conductor at one individual plug-in contact, it is described that it is necessary to eliminate the disadvantageous overtightening of the terminal screw when screwing the same into thin sheet metal when connecting relatively large conductor cross sections, and that the disadvantage is eliminated in the internal thread region through the use of a double sheet metal layer or by lengthening the thread by providing a raised rim at a cage clamp, as is described in German Application DE 103 15 668 A1 or the German Examined Application DE 1 690 745 B for connecting the conductor to a conductor bar. Moreover, in place of double-layer cage clamps, the German Patent DE 37 32 267 C1 or the Swiss CH 392 658 discuss also using cage clamps fabricated from solid material especially for connecting electrical conductors to thin sheet-metal strips.

Vibrations have a detrimental effect when working with electrical plug connectors that are equipped with a PE ground conductor system having this aforementioned conventional screw connection technology. A vibrational stress can induce loosening of the clamp connection between the ground conductor and the screw connection, necessitating a retightening of the clamping screw and thereby giving rise to the overtightening problem described above. The conductors to be connected are, therefore, provided with ring or cable lugs that are fastened to this screw connection in a complex process that requires taking the conductor length into account. This type of fastening process is time-consuming since it requires crimping-on the conductor, and it is not operator-friendly since it requires completely unscrewing the fastening screw. The ring lugs of the particular conductor cross section frequently do not match the fastening screw diameter.

A further drawback is that, in the context of the aforementioned screw connection technology, the minimal amount of corrosion protection provided by galvanic coatings can have a negative effect on the long-term functioning of the screw connection. When installing the ground conductor, the clamp connection can become damaged at the surface by the tool to be used.

However, due to the small unit volume of such plug connectors, the connection device for a ground conductor is not able to be readily equipped with a cage clamp. Further designs would be required to permit the use of a cage clamp. For these reasons, however, methods heretofore have not provided that this ground conductor connection point be equipped with cage clamps for connecting the ground conductor. Surface damage to the clamp connection can produce oxidation. Such oxidation increases the risk of rusting and the consequences thereof. These consequences can include a poor electrical conductivity of the clamping point for the ground conductor, for example.

In addition, it would be beneficial to rationalize the production of the metal part, for example, of the fixing bracket, by saving a manufacturing step. Such a rationalization could eliminate the need for the threaded bore in the metal part of the fixing bracket for the screw connection, thereby saving a manufacturing step.

SUMMARY

An aspect of the present invention is to provide an electrical plug connector having a screw connection for the PE ground conductor system that will provide a technical approach for designing the screw connection, and make it possible to provide a reliable mechanical connection and a reliable electrical contact.

In an embodiment, the present invention provides an electrical plug connector. The electrical plug connector includes an insulating body supporting electrical contact elements having a connector portion and a conductor connection portion. An electrically conductive metal element is disposed on a narrow portion of the electrical plug connector and formed as a single piece. At least one retaining element is configured to contact a respective at least one contact insert and has at least one flange with at least one punched hole configured to fasten the electrical plug connector to at least one of a housing and a control cabinet. A conductor bar has a screw connection for a ground conductor and a potential equalization bar. A tension sleeve has a terminal screw configured to connect the ground conductor with the electrically conductive metal element. A U-shaped frame is configured to receive and guide the tension sleeve. The conductor bar is disposed on the electrically conductive metal element angularly offset from the U-shaped frame and is configured to engage the tension sleeve.

BRIEF DESCRIPTION OF THE DRAWINGS

An exemplary embodiment of the present invention is illustrated purely schematically in the drawing and is described in greater detail in the following. Specifically, in the drawings.

DETAILED DESCRIPTION

Figure 1:
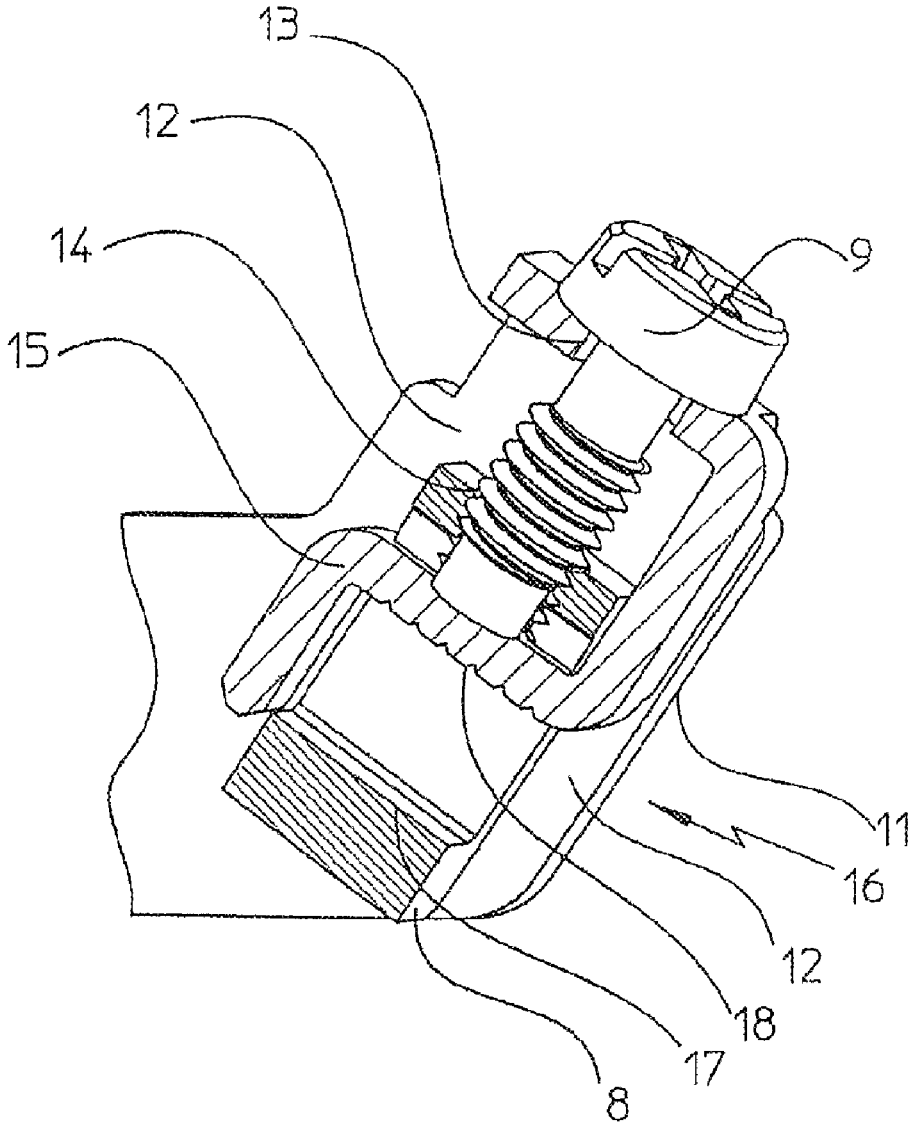
Fig.1 PRIOR ART
FIG. 1 shows a prior art screw connection for PE ground conductors in accordance with an embodiment of the present invention.

To provide a multipole terminal adapter equipped with these features of the present invention and/or contact inserts for electrical plug connectors, the insulating body supporting the contact elements having a connector side and a conductor connection side, an embodiment of the present invention provides for a PE ground conductor system, that is constituted of a one-piece, electrically conductive metal part and of a clamp connection that includes a tension sleeve having a corresponding terminal screw, to be used along the transversal side.

The one-piece metal part is advantageously manufactured from brass. Other electrically conductive materials are conceivable. Using the punching, folding and bending technique, it is possible to form a one-piece metal part in one manufacturing step in such a way that, on the one hand, the form having punched holes in the flanges is suited for fastening by screws to control cabinets, for example, and having retaining elements, for example, for fastening to contact inserts, in particular, and, on the other hand, a metal frame is formed for the tension sleeve technique that is suited for incorporating the tension sleeve technique without using additional elements. For this purpose, the metal frame has a bottom opening. The opening is used for accommodating the tension sleeve. A through bore is located in the top frame part. When assembling the one-piece metal part using the tension sleeve technique, the terminal screw is introduced from above through the through bore, and the tension sleeve is introduced from below through the frame opening. The connection between the terminal screw and the tension sleeve is established by screwing the terminal screw into place into the threaded opening provided for that purpose in the tension sleeve. Simple tension sleeves are described, for example, in German DE 42 28 025 or DE 94 08 053. The tension sleeve principle is applied in series-terminal and printed-circuit-board connection technology, for example.

The tension sleeve according to an embodiment of the present invention and the terminal screw are advantageously made of a stress-corrosion cracking resistant high-grade copper alloy, thereby eliminating the risk of rusting and the consequences thereof, such as uncertain contact conditions and/or a jammed screw.

When the tension sleeve technique according to an embodiment of the present invention is applied to the PE ground conductor system for terminal adapters and contact inserts, depending on the particular requirement, a connection cross section of up to 10 $mm^2$ or greater is used for the clamping body design to prevent accidental loosening of the terminal screw. The function is based on the elevator principle. In response to actuation, the terminal screw is braced against the electrically conductive element (referred to in the following as top metal frame) and pulls the ground conductor located in the tension sleeve against the conductor bar. Due to the high clamping force resulting from the tightening torque of the terminal screw, the clamping body of the tension sleeve also self-deforms in the threaded bore region. This means that the threaded bore becomes out-of-round due to the elastic deformation of the clamping body (tension sleeve). The out-of-round threaded bore produces a clamping effect and the thread friction increases. This clamping effect is produced by a groove that is configured in the tension sleeve in the area of the threaded bore and the side facing the ground conductor opening. Thus, this precludes any loosening of the clamp connection of the PE ground conductor system in response to vibration. An enhanced corrosion protection is provided since the clamp connection is made of a high-grade copper alloy, and the need for the threaded bore previously required in the metal part for the screw-connection clamping means of the ground conductor is eliminated through the use of the tension sleeve technique. Thus, even under conditions of vibrational stress, the tension sleeve technique ensures a reliable mechanical connection and a reliable electrical contact. Therefore, there is no need for retightening the PE terminal screw.

In addition, the one-piece, electrically conductive metal part of the PE ground conductor system is designed to also have a potential equalization bar as a leading PE terminal contact. This leading PE terminal contact has two tasks. The first task is to always reliably contact the ground conductor first in the case of obliquely disposed female or male inserts. The second task is to ensure that the potential equalization bar functions as a continuous PE ground conductor system. The continuity of the potential equalization is ensured by the potential equalization bar in the case of the integration of a terminal adapter having a female insert and a terminal adapter having a male insert, for example.

FIG. 1 shows a prior art PE screw connection. This PE screw connection is bolted onto a potential equalization system (not shown). The purpose of the PE screw connection is to accommodate a green-yellow ground conductor. Therefore, the PE screw connection is constituted of a metal screw, which is surface-coated with a galvanic layer, and of a square-shaped metal plate, which clamps the ground conductor and is curved in an umbrella form toward the screw-head seating surface. In addition, the metal plate is provided at the surface with grooves and is likewise galvanically zinc- or nickel-plated.

Figure 2:
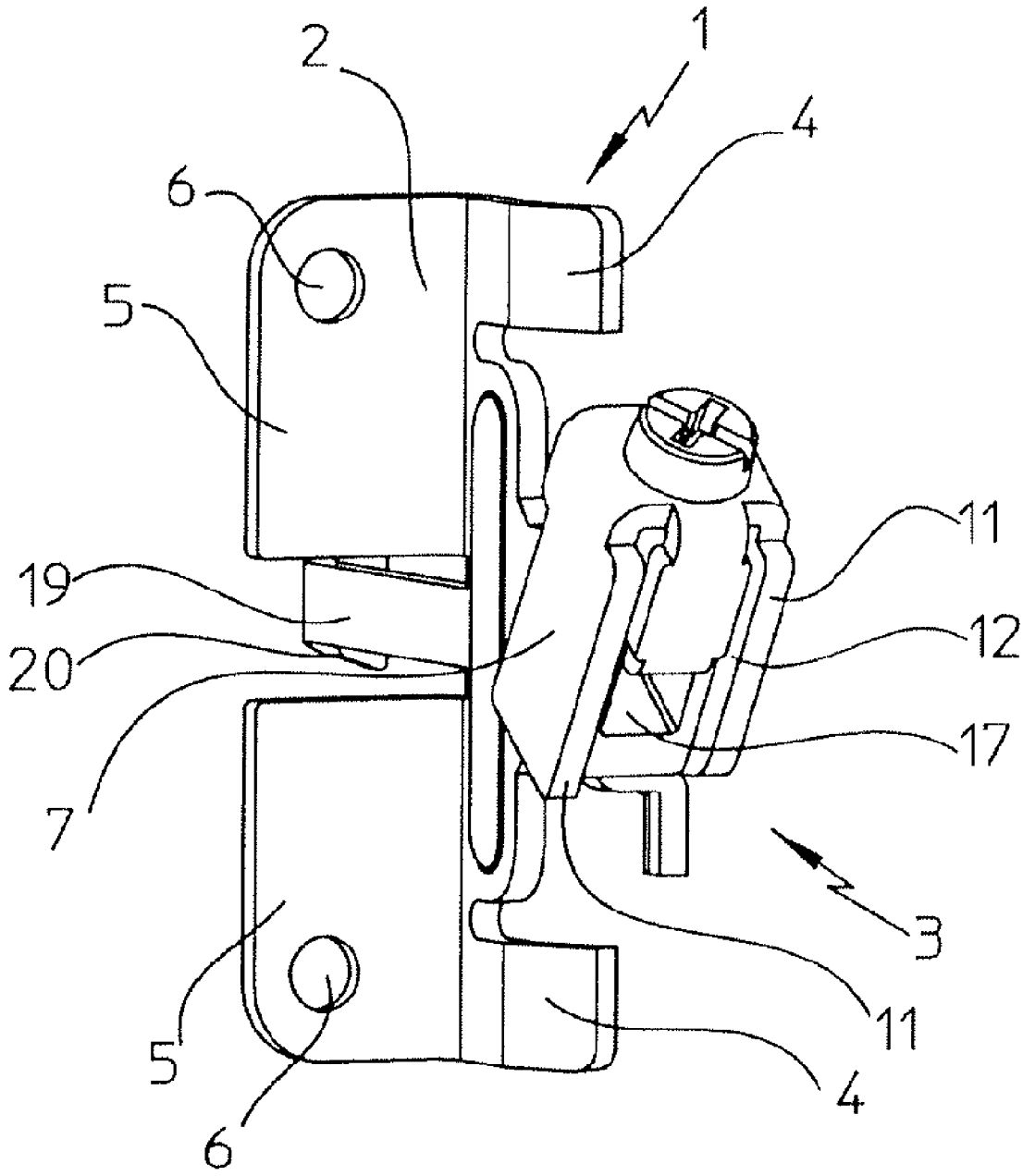
FIG. 2 shows a screw-type terminal connection featuring tension sleeve technology in accordance with an embodiment of the present invention.

In the case of the PE ground conductor system 1 according to an embodiment of the present invention illustrated in a perspective representation in FIG. 2 that is composed of a one-piece, electrically conductive metal part 2, preferably of brass, a PE terminal connection 3 featuring tension sleeve technology is shown.

The one-piece PE metal part 2 fabricated using a punching technique and formed using a folding and bending technique is constituted of at least one retaining element 4, preferably of two retaining elements 4, for joining or fastening PE metal part 2 to contact inserts (not shown), for example. In addition, PE metal part 2, in the form that is angularly offset from retaining elements 4, has at least one flange 5, preferably two flanges 5, which are equipped with a punched hole 6 in flange 5. The purpose of holes 6 is to lead through screws for fastening the contact insert in connector housings (not shown), for example, in control cabinet lead-throughs (not shown), or for installation on adapter plates (not shown). PE metal part 2 extends perpendicularly to flange 5 and in parallel to retaining elements 4, and terminates at a U-shaped metal frame 7, forming the same. The purpose of U-shaped metal frame 7 is to accommodate PE terminal connection 3 used in the tension sleeve technique. PE terminal connection 3 is composed of a tension sleeve 8 and of corresponding PE terminal screw 9. U-shaped metal frame 7 has a plurality of openings for accommodating tension sleeve 8.

A front and rear opening are provided to allow the PE ground conductor to access the ground conductor opening in tension sleeve 8. Bottom opening 10 is configured to allow introduction of tension sleeve 8 between the two legs 11 of U-shaped metal frame 7. Legs 11 of U-shaped metal frame 7 form side guide walls 12 for tension sleeve 8 that is slidable therebetween in accordance with the elevator principle. Tension sleeve 8 slides up or down in response to the torsional twisting of PE terminal screw 9. To this end, PE terminal screw 9 is inserted into punched through bore 13 in the top portion of metal frame 7 and screwed into threaded bore 14 of tension sleeve 8 provided for that purpose. Tension sleeve 8 is shifted in response to further torsional twisting of PE terminal screw 9. If a PE ground conductor is inserted into tension sleeve 8, PE ground conductor is pressed, along with tension sleeve 8, against PE terminal screw 9 in response to the torsional twisting of PE terminal screw 9 (not shown in FIG. 2).

In another embodiment of a one-piece PE metal part 2 (see FIG. 2), U-shaped metal frame 7 has an additional, angularly offset conductor bar 15 that is configured to accommodate terminal connection 3 and is positioned on U-shaped metal frame 7 in a way that allows conductor bar 15 to engage into PE ground conductor opening 16 of tension sleeve 8. Conductor bar 15 ensures that even thin PE connection ground conductors are properly and reliably clamped in the flat clamping-body bottom 17 when tension sleeve 8 moves. Transversal grooves 18 in the bottom side of conductor bar 15, thus in the side facing the PE ground conductor, that extend in parallel to clamping body bottom 17 and tangentially to inserted PE ground conductor, additionally provide for a breaking through of any existing oxide layers on the PE ground conductor. Most notably, however, transversal grooves 18 provide for a pull-proof PE ground conductor connection and thus ensure good contact conditions.

In the case of one-piece metal part 2, a potential equalization bar 19 in the form of a leading PE connection grounding contact 20 extends perpendicularly to flanges 5 and oppositely to the facing-away side of clamp connection 3 that accommodates metal frame 7. When installing heavy-duty industrial plug connectors, leading PE connection grounding contact 20 ensures a continuous PE ground conductor system 1.

Figure 3:
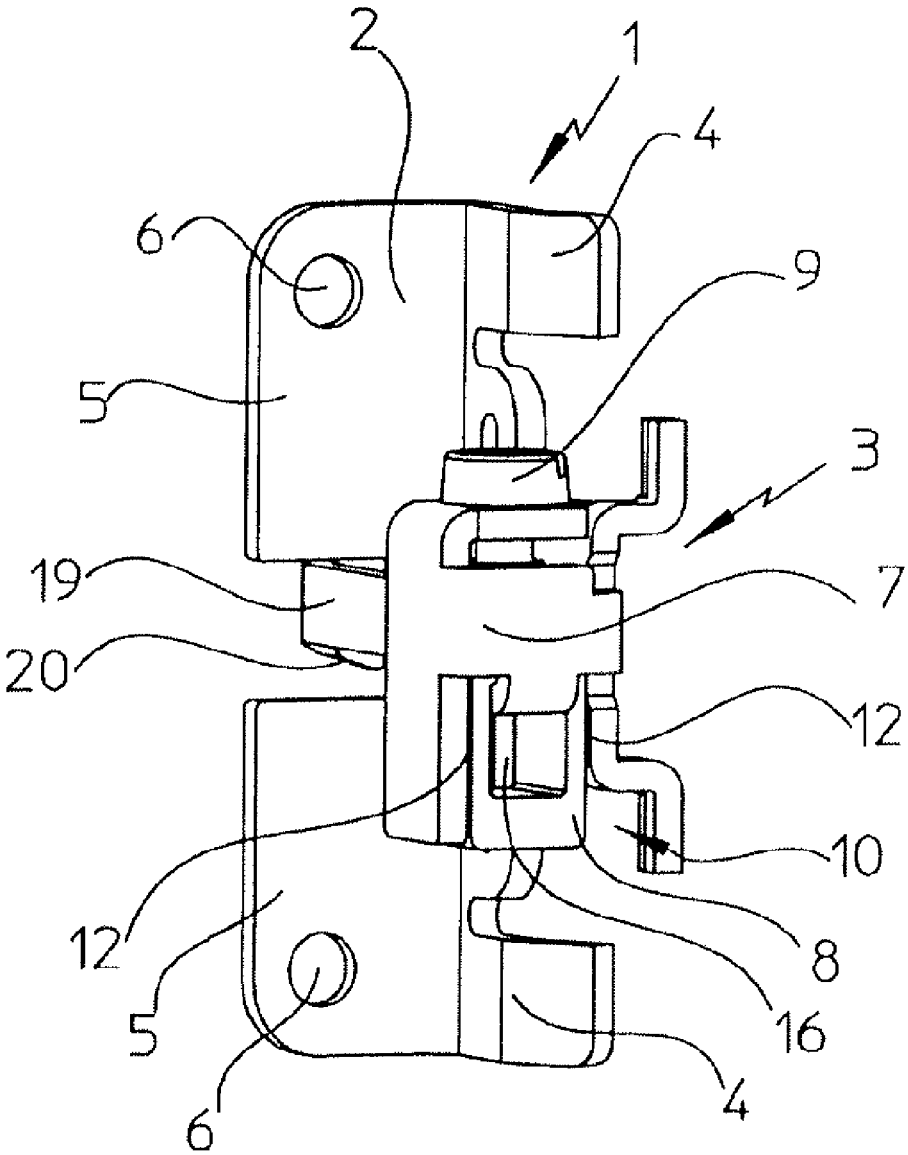
FIG. 3 shows an angularly offset screw-type terminal connection featuring tension sleeve technology in accordance with an embodiment of the present invention.

PE ground conductor system 1 illustrated in FIG. 3, that is composed of a one-piece, electrically conductive metal part 2 and of a terminal connection 3 featuring tension sleeve technology, differs from the embodiment in FIG. 2 in that clamp connection 3 is not disposed perpendicularly to potential equalization bar 19 and does not extend in parallel to flanges 5, rather that U-shaped metal frame 7, whose purpose is to accommodate the tension sleeve technology, is angularly configured on metal part 2. The inclination of clamp connection 3 is approximately 30-60 degrees, preferably 45 degrees relative to the perpendicular surface of flange 5. Other inclination angles outside of the previously mentioned angular degrees are conceivable.

The terminal adapters that are optionally equipped with socket or plug connectors and that feature PE ground conductor system 1 according to an embodiment of the present invention are preferably manufactured using the technique which provides for an angularly disposed PE tension sleeve, as illustrated in FIG. 3.

While the invention has been particularly shown and described with reference to preferred embodiments thereof, it will be understood by those skilled in the art that various changes in form and details may be made therein without departing from the spirit and scope of the invention.

LIST OF REFERENCE NUMERALS

1 PE ground conductor system
2 one-piece metal part
3 terminal connection
4 retaining element
5 flange
6 punched hole
7 metal frame
8 tension sleeve
9 terminal screw
10 bottom opening
11 leg
12 side guide walls
13 through bore
14 threaded bore
15 conductor bar
16 opening for ground conductor
17 clamping body bottom

18 transversal grooves
19 potential equalization bar
20 terminal contact

The invention claimed is:

1. An electrical plug connector, comprising:

an insulating body supporting electrical contact elements having a connector portion and a conductor connection portion;

an electrically conductive metal element disposed on a narrow portion of the electrical plug connector and formed as a single piece;

at least one retaining element configured to contact a respective at least one contact insert and having at least one flange with at least one punched hole configured to fasten the electrical plug connector to at least one of a housing and a control cabinet;

a conductor bar having a screw connection for a ground conductor and a potential equalization bar;

a tension sleeve having a terminal screw configured to connect the ground conductor with the electrically conductive metal element; and a U-shaped frame configured to receive and guide the tension sleeve, wherein the conductor bar is disposed on the electrically conductive metal element angularly offset from the U-shaped frame and is configured to engage the tension sleeve.

2. The electrical plug connector as recited in claim 1, wherein the electrical plug connector is at least one of a multipole terminal adapter and a contact insert.

3. The electrical plug connector as recited in claim 1, wherein the U-shaped frame includes a metal.

4. The electrical plug connector as recited in claim 1, wherein the electrically conductive metal element includes brass.

5. The electrical plug connector as recited in claim 1, wherein the U-shaped frame includes legs for guiding the tension sleeve.

6. The electrical plug connector as recited in claim 1, wherein the angularly offset conductor bar includes an abutment so as to limit an insertion of the ground conductor into the tension sleeve.

7. The electrical plug connector as recited in claim 1, wherein the potential equalization bar is configured as a leading grounding contact.

8. The electrical plug connector as recited in claim 7, wherein the potential equalization bar is disposed on the electrically conductive metal element.

9. The electrical plug connector as recited in claim 1, wherein the tension sleeve is configured to clamp ground conductors having different cross sections.

* * * * *